United States Patent [19]

Emmerich et al.

[11] Patent Number: 4,487,453

[45] Date of Patent: Dec. 11, 1984

[54] SEAT RECLINER ADJUSTMENT MECHANISM

[75] Inventors: Harold E. Emmerich, McClure; Larry A. Richer, Wauseon, both of Ohio

[73] Assignee: Gendron, Inc., Archbold, Ohio

[21] Appl. No.: 453,217

[22] Filed: Dec. 27, 1982

[51] Int. Cl.[3] ..... A61G 5/00; G05G 5/06

[52] U.S. Cl. ..... 297/367; 297/366; 297/370; 297/377; 74/541

[58] Field of Search ..... 297/377, 366, 367, 370; 108/148; 5/74, 77; 74/541, 536, 537, 538, 529; 248/409, 412

[56] References Cited

U.S. PATENT DOCUMENTS

| | | | |
|---|---|---|---|
| 172,281 | 1/1876 | Seng | 297/370 |
| 1,630,870 | 5/1927 | Strunck | 248/412 |
| 1,859,223 | 5/1932 | Stevensen | 248/412 |
| 1,975,492 | 10/1934 | Wyndham | 74/541 |
| 2,121,238 | 6/1938 | Whedon et al. | 297/370 |
| 2,755,843 | 7/1956 | Carlson | 297/366 |
| 3,666,292 | 5/1972 | Bartos | 297/DIG. 4 |

FOREIGN PATENT DOCUMENTS

| | | | |
|---|---|---|---|
| 2540054 | 3/1977 | Fed. Rep. of Germany | 297/377 |

*Primary Examiner*—William E. Lyddane
*Assistant Examiner*—Mark W. Binder
*Attorney, Agent, or Firm*—Fraser, Barker, Purdue & Clemens

[57] ABSTRACT

The present invention relates to a seat recliner adjustment mechanism for a wheelchair having an upper back rest frame pivotally mounted to a lower seat frame. The adjustment mechanism includes an elongate rack member pivotally mounted to the lower seat frame and having a plurality of spaced apart detent engaging means extending along one side thereof. A locking mechanism is mounted on the back rest frame and includes a detent element engageable with a selected one of the detent engaging means of the rack member for maintaining the back rest frame in a selected reclined position. The locking mechanism includes a wedge element normally biased in a locked position to urge the rack member into locking engagement with the detent element. The wedge element is moveable to a released position wherein the rack member is disengaged from the detent element to enable the back rest frame to pivot relative to the lower seat frame.

1 Claim, 3 Drawing Figures

SEAT RECLINER ADJUSTMENT MECHANISM

BACKGROUND OF THE INVENTION

The present invention relates generally to a seat recliner adjustment mechanism and, in particular, to a mechanism for adjusting the reclined position of a back rest portion of a wheelchair.

Seat recliner adjustment mechanisms are well known and widely used, especially in automotive applications. Examples of automotive type seat recliner mechanisms are disclosed in U.S. Pat. Nos. 3,833,965 and 4,188,064.

In addition to automotive seat recliner mechanisms, adjustment mechanisms have also been developed for use on conventional wheelchair assemblies. U.S. Pat. No. 3,666,292 to Bartos discloses a wheelchair having a recliner adjustment mechanism wherein an elongate hook support pivotally mounted to the lower chair frame is spring biased into locking engagement with a selected one of a plurality of apertures formed along a back rest frame member.

Another wheelchair recliner adjustment mechanism is disclosed in U.S. Pat. No. 4,079,990 to McMunn et al. In this patent, a locking pin mounted on the back rest frame is spring biased into a selected one of a plurality of apertures formed in a plate secured to the lower chair frame. A lever, which is positioned adjacent the control handle at the upper end of the back rest frame, is coupled to retract the locking pin from the aperture to enable the back rest to be pivoted to another reclined position.

SUMMARY OF THE INVENTION

The present invention relates to a seat recliner adjustment mechanism which, in its preferred embodiment, is adapted for use with a conventional wheelchair. The adjustment mechanism includes a rack member having one end pivotally mounted to the lower wheelchair seat frame and having a plurality of spaced apart detent engaging means extending along one side thereof. A locking means is mounted on the upper wheelchair back rest frame and includes a detent element adapted to engage a selected one of the detent engaging means on the rack member.

In the preferred embodiment of the adjusting mechanism, a wedge element is utilized to pivot the rack member into locking engagement with the detent element. A biasing means normally biases the wedge element into a locked position to maintain the rack member in locking engagement with the detent element. A release means is provided for moving the wedge element to a released position to disengage the rack member from the detent element and permit relative pivotal movement between the back rest frame and the lower seat frame. The release means is provided with a handle portion positioned adjacent a control handle on the back rest frame of the wheelchair such that an attendant can release the locking mechanism while simultaneously grasping the control handle to pivot the back rest portion of the chair to the selected reclined position.

BRIEF DESCRIPTION OF THE DRAWINGS

The above, as well as other advantages of the present invention, will become readily apparent to one skilled in the art from reading the following detailed description when considered in light of the following drawings, in which.

DESCRIPTION OF THE PREFERRED EMBODIMENT

It should be noted at the outset of this description that, while the adjustment mechanism of the present invention is described for use in a reclining wheelchair, it will be readily apparent that the adjustment mechanism can be utilized for other types of reclining seats. In addition to a recliner adjustment for seats, the present invention can be utilized in any device or assembly wherein it is desired to adjust the pivoted position of one member which is pivotally connected to a second member.

Figure 1:
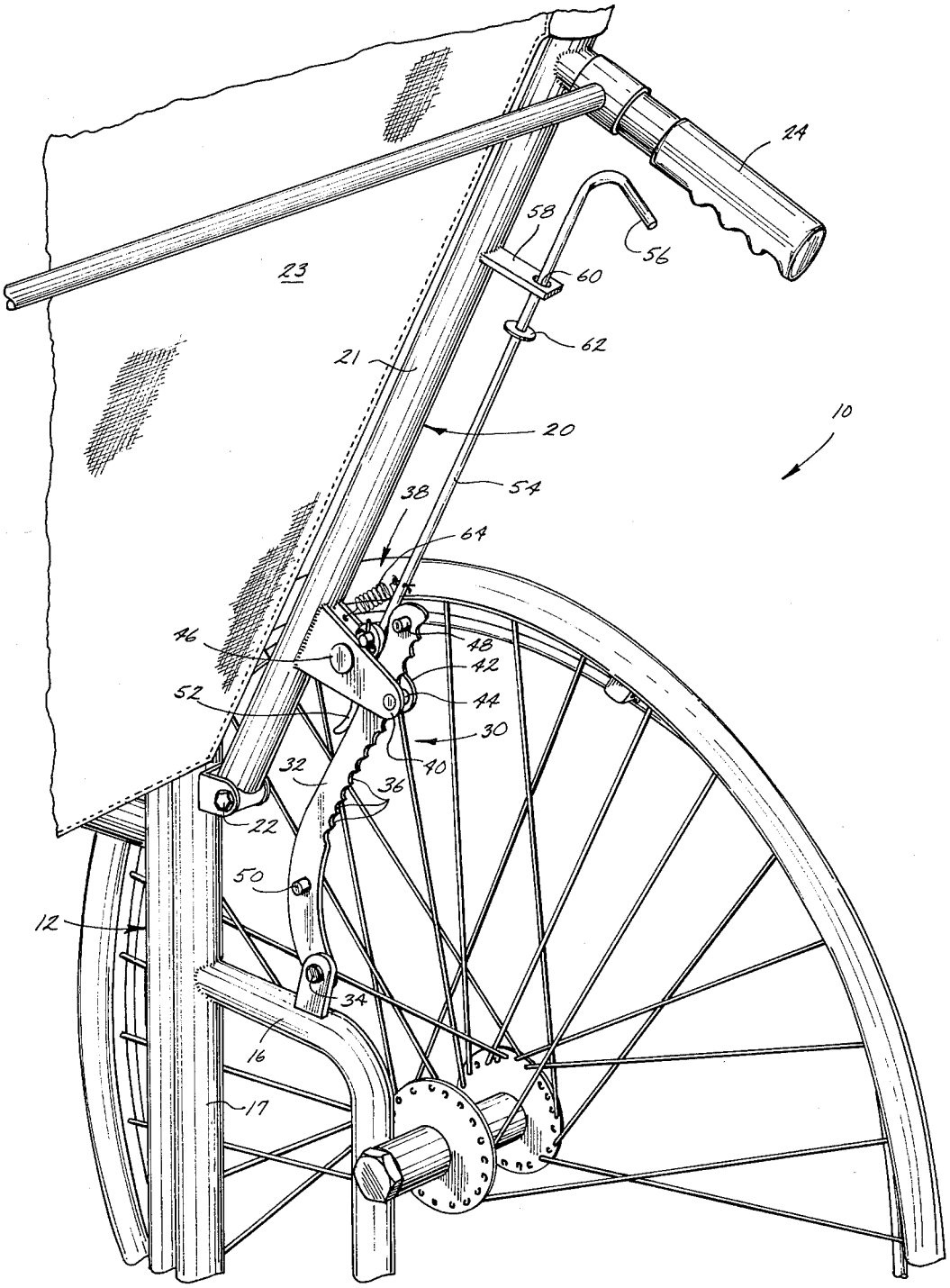
FIG. 1 is a perspective view of a recliner adjustment mechanism embodying the principles of the present invention, illustrating the mechanism mounted on a wheelchair assembly.

Referring to FIG. 1, there is shown a portion of a conventional wheelchair 10 having a lower side frame 12 which is maintained in spaced apart relationship with an opposite side frame (not shown) by a conventional collapsible X-frame (not shown). A flexible fabric seat portion (not shown) is supported between the two side frames. A conventional wheelchair wheel assembly 14 is mounted on a lower frame member 16 which extends rearwardly and downwardly from a generally vertical lower side frame member 17.

An upper back rest frame 20 includes a pair of spaced apart frame members 21 (only one of which is shown in FIG. 1) having their lower ends pivotally connected to the upper ends of the side frame member 17 at 22. A flexible fabric back rest portion 23 is supported between the upper frame members 21. The back rest frame 20 is provided with a pair of spaced apart rearwardly extending control handles 24 (only one of which is shown in the drawings) which are utilized by an attendant to maneuver the wheelchair and, as will be discussed, to assist the attendant in positioning the back rest frame 20 in the desired reclined position.

The adjustment mechanism of the present invention, generally represented by reference numeral 30, is utilized to maintain the back rest portion 23 in a selected reclined position relative to the seat portion of the wheelchair. The adjustment mechanism 30 includes an elongate rack member 32 having its lower end pivotally connected to the frame member 16 at 34. The rack member 32 is provided with a plurality of spaced apart detent engaging means such as recesses 36 extending along one longitudinal edge thereof.

A locking mechanism, generally represented by reference numeral 38, is secured to the back rest frame member 21 and is adapted to securely engage one of the recesses 36 on the rack member 32 for maintaining the back rest portion 23 in a selected reclined position. The locking mechanism 38 includes a pair of spaced apart flanges 40 and 42 which are secured to and extend rearwardly from the back rest frame member 21. A detent such as a locking pin 44 extends between the rearward ends of the flanges 40 and 42, while a wedge support pin 46 extends between the flanges 40 and 42 and is positioned between the back rest frame member 21 and the locking pin 44.

Figure 2:
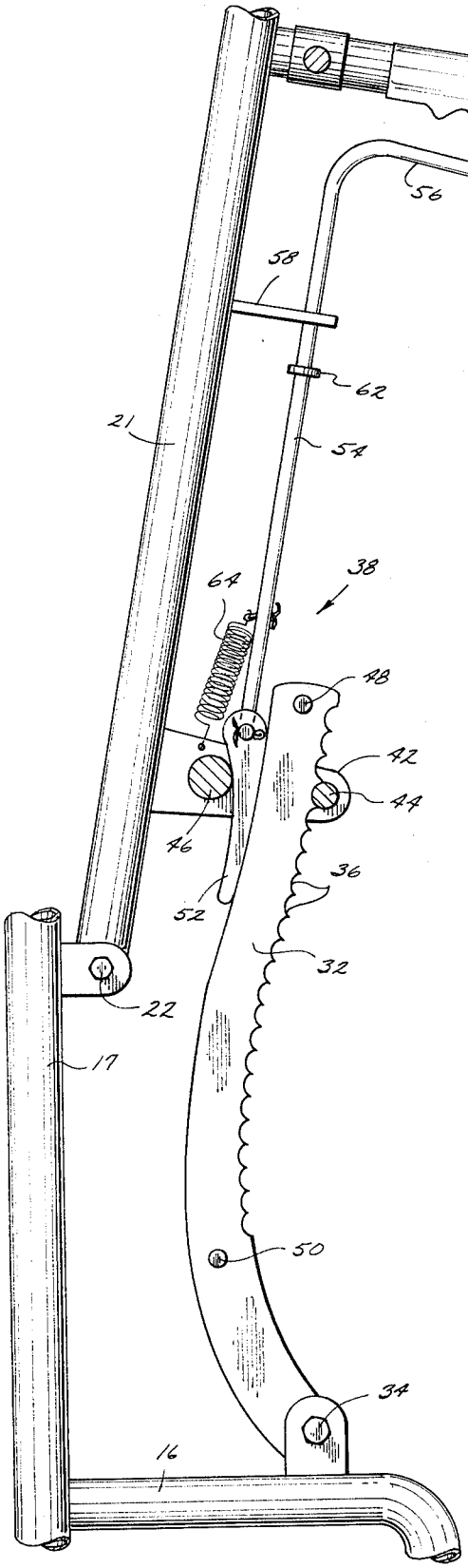
FIG. 2 is a side elevational view, partly in section, of the adjustment mechanism of FIG. 1 with the components of the mechanism in the locked position.
Figure 3:
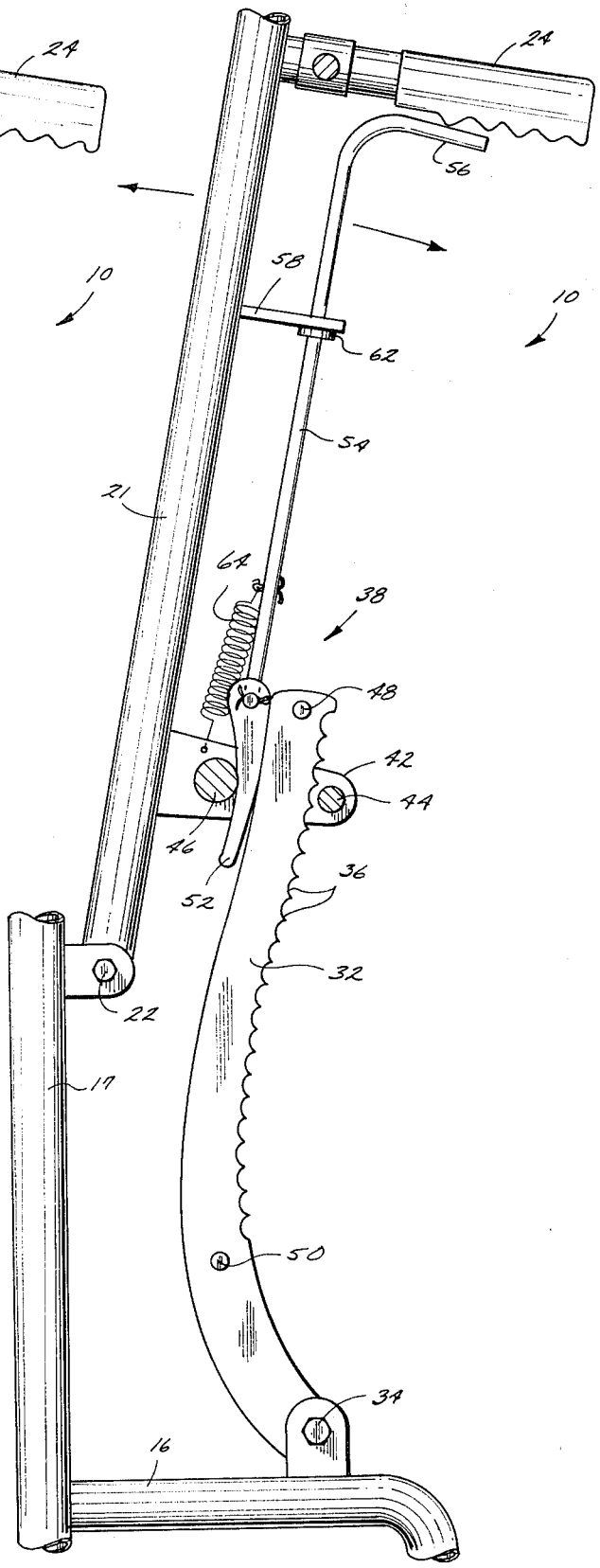
FIG. 3 is a partial elevational, partial sectional view, similar to FIG. 2, but showing the components of the mechanism in the released position.

As shown in FIGS. 2 and 3, the rack member 32 is adapted to be inserted between the flanges 40 and 42 in the space between the wedge support pin 46 and the locking pin 44. The rack member 32 is provided with an upper stop member 48 and a lower stop member 50 to limit the slidable movement of the rack member between the flanges 40 and 42.

A wedge element 52 is utilized to maintain the locking pin 44 in locking engagement with a selected one of the recesses 36 of the rack member 32. The wedge element 52 includes a lower end which is insertable between the rack member 32 and the wedge support pin 46. The upper end of the wedge element 52 is pivotally connected to the lower end of a release arm 54 which extends upwardly along the back rest frame member 21 and is formed with a rearwardly extending handle portion 56. A support member 58 welded to the frame member 21 has an aperture 60 formed therein for slidably receiving the longitudinally extending portion of the release arm 54. An annular stop member 62 cooperates with support member 58 to limit the upward movement of the release arm 54.

A biasing tension spring 64 has one end connected to the flange 42 and an opposite end connected to the lower end of the longitudinally extending portion of the release arm 54. The spring 64 maintains a downward force on the release arm 54 to cause the wedge element 52 to be urged downwardly between the wedge support pin 46 and the rack member 32 to maintain the rack member in locking engagement with the locking pin 44. When it is desired to move the back rest portion 23 of the chair to another position, the release arm 54 is moved upwardly to lift the wedge element 52 and enable the rack member 32 to pivot out of locking engagement with the locking pin 44, as shown in FIG. 3. As shown in the drawings, the handle portion 56 of the release arm is spaced a suitable distance below the wheelchair handle 24 to enable the wheelchair attendant to operate the release arm and disengage the locking mechanism while simultaneously grasping the wheelchair control handle 24. Once the rack member is disengaged from the locking pin 44, the back rest portion 23 can be pivoted to the selected position, and the release arm can then be allowed to return to its normal downwardly biased position to lock the back rest in the selected position.

It will be readily apparent to one skilled in the art that the opposite side frame of the wheelchair (not shown in the drawings) can be provided with a similar adjustment mechanism.

In accordance with the provisions of the patent statutes, the principle and mode of operation of the invention have been explained and illustrated in its preferred embodiment. However, it must be understood that the invention may be practiced otherwise than as specifically illustrated and described without departing from its spirit or scope.

What is claimed is:

1. A recliner adjustment mechanism for a wheel chair having an upper backrest frame member pivotally mounted relative to a lower frame member, comprising:

a. an elongate rack having a plurality of spaced apart detent engaging means extending along one side thereof;

b. a bracket having a detent element engageable with at least a selected one of the detent engaging means of said rack;

c. a wedge support pin on said bracket and spaced from the detent element, said rack extending between said wedge support pin and said detent element;

d. a wedge element slidably disposed between said wedge support pin and said rack, and being moveable between a locked position wherein at least a selected one of the detent engaging means of said rack is urged into locking engagement with said detent element and a release position wherein said rack is disengaged from said detent element;

e. means coupled to said wedge element for moving said wedge element between the locked and released positions;

f. means for normally biasing said wedge element into the locked position;

g. means pivotally interconnecting said rack to one of the frame members; and h. means connecting said bracket to the other of the frame members.

* * * * *